US005709327A

United States Patent [19]

LaMacchia et al.

[11] Patent Number: 5,709,327

[45] Date of Patent: Jan. 20, 1998

[54] BRACELET FASTENING DEVICE

[76] Inventors: Ralph LaMacchia, 210-16 69th Ave., Bayside, N.Y. 11364; Barbara Bush, 5 Humming La., Commack, N.Y. 11725

[21] Appl. No.: 697,638

[22] Filed: Aug. 29, 1996

Related U.S. Application Data

[60] Division of Ser. No. 400,024, Mar. 6, 1995, abandoned, which is a continuation-in-part of Ser. No. 24,845, Jun. 22, 1994, Pat. No. Des. 363,042.

[51] Int. Cl.[6] ..... A47G 25/90; A41F 1/00

[52] U.S. Cl. ..... 223/111; 24/499; 24/530

[58] Field of Search ..... 223/111, DIG. 2; 24/499, 530

[56] References Cited

U.S. PATENT DOCUMENTS

| | | | |
|---|---|---|---|
| D. 323,132 | 1/1992 | Grennan . | |
| 392,397 | 11/1888 | Babcock . | |
| 731,103 | 6/1903 | Frank . | |
| 839,226 | 12/1906 | Sturm | 24/499 |
| 1,795,256 | 3/1931 | Johnson . | |
| 2,900,205 | 8/1959 | Cirone . | |
| 2,926,875 | 3/1960 | Hoye . | |
| 4,014,079 | 3/1977 | Camarda . | |
| 5,249,832 | 10/1993 | Leonardz . | |
| 5,301,393 | 4/1994 | Brown | 24/499 |
| 5,452,500 | 9/1995 | Revis | 24/499 |

OTHER PUBLICATIONS

*Miles Kimball® Catalog*, 1991, p. 30, Item No. 0520–23—Clasp Clamp.

*Miles Kimball® Catalog*, 1994, p. 57, Item No. 505206—Jewelry Clasp.

*Primary Examiner*—Bibhu Mohanty
*Attorney, Agent, or Firm*—Galgano & Burke

[57] ABSTRACT

A bracelet fastening device to assist a person in quickly and easily fastening a bracelet around his or her own wrist. The device overcomes the problems associated with fastening a bracelet around one's own wrist without the assistance of another person and particularly by a person with impaired fine motor skills. The device generally includes a handle and releasable clamping means operably attached to the handle. The clamping means is operable to releasably hold at least one interlocking member of a releasable clasp of a bracelet. The handle is sized and configured to be held in a hand of a person so that the clamping means is positioned to rest on a wrist adjoining the hand holding the handle. A person using the bracelet fastening device can hold and position with one hand at least one interlocking member of the releasable clasp on the adjoining wrist while using the other free hand to fasten the other interlocking member of the clasp therewith to securely retain the bracelet around the wrist.

12 Claims, 3 Drawing Sheets

FIG. 4
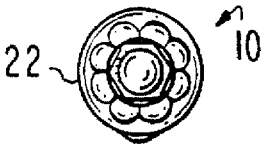
FIG. 2
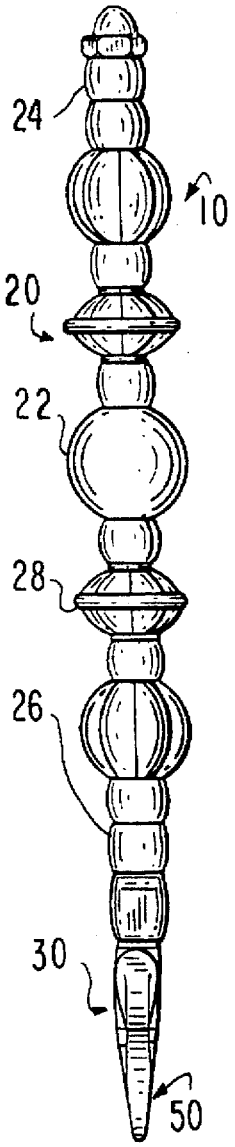
FIG. 1
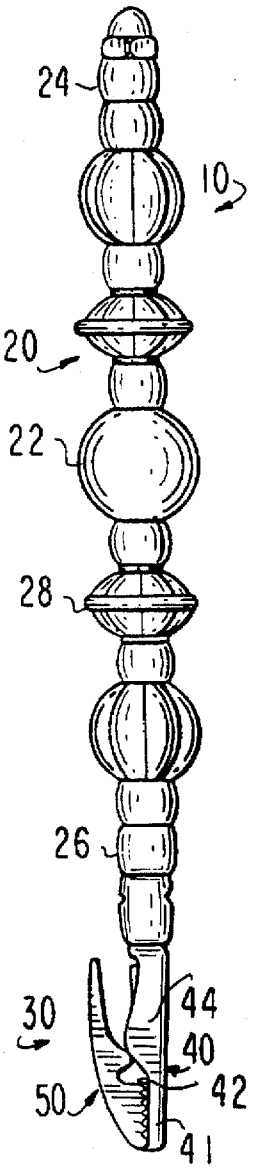
FIG. 3
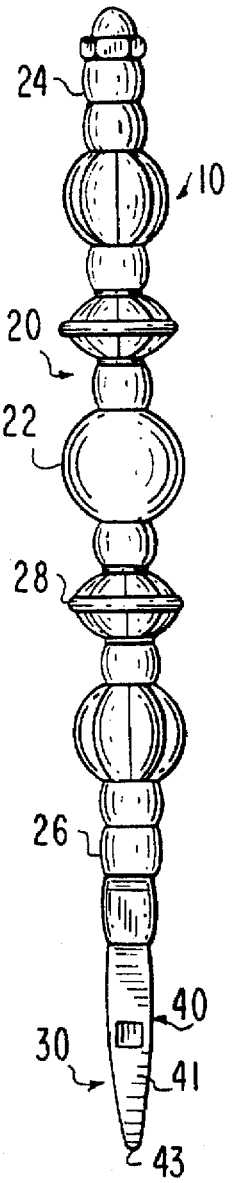
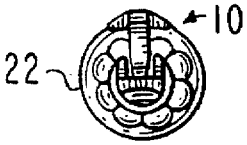
FIG. 5

BRACELET FASTENING DEVICE

RELATED APPLICATION

This application is a divisional of application Ser. No. 08/400,024 now abandoned filed Mar. 6, 1995 which, in turn, is a continuation-in-part of Ser. No. 024,845 now U.S. Pat. No. Des. 363,042 issued Oct. 10, 1995.

BACKGROUND OF THE INVENTION

The present invention relates generally to a device for use in fastening jewelry. More particularly, the present invention relates to a bracelet fastening device for use in assisting a person in fastening a bracelet around his or her wrist.

Jewelry, such as rings, broaches, necklaces, and bracelets, is widely used by women and men for ornamentation. Particularly, bracelets are ornamental bands or chains, or string of beads or pearls worn around a person's wrist. Although, some bracelets are formed from various materials into the shape of a continuous band that is slid over a person's hand, most bracelets have a releasable clasp for connecting together the two ends of the bracelet to securely retain the bracelet around a person's wrist.

A typical clasp has a first interlocking member and a second releasably operable, usually spring biased, interlocking member, each of which is attached to opposite ends of a bracelet. An example of a typical clasp, for connecting the ends of a bracelet and securing the bracelet around a person's wrist, generally consists of a small continuous ringlet or loop at one end of the bracelet and a releasably operable hook or loop attached at the other end of the bracelet. The releasably operable hook interlocks with the ringlet to connect the two ends of the bracelet together.

Another example of a typical clasp, for use in connecting the ends of a bracelet and securing the bracelet around a person's wrist, generally includes a receiving member having a cavity attached at one end the bracelet and a mating member having an insertable projection attached at the other end of the bracelet. Either of the receiving or the mating members can be releasably operable. The mating member interlocks with the receiving member to connect the two ends of the bracelet together. Various other configurations of releasable clasps have been devised for connecting the ends of a bracelet together and retain it around a person's wrist.

A major problem with a bracelet having a releasable clasp is in the effort required by a person to easily and quickly fasten the bracelet around his or her wrist. Manually fastening a bracelet around one's wrist requires an individual to exhibit great dexterity. First, the hand, adjoining the wrist upon which the bracelet is to be worn, is often of no help in manipulating the clasp. Often, a person must solely use one hand, the hand opposite from the wrist to which the bracelet is to be worn, to hold the first interlocking member in place on their wrist while attempting to connect the second usually releasably operable interlocking member. Frequently, a person needs to try several times in order to successfully connect the clasp of the bracelet when trying to fasten it around his or her wrist.

SUMMARY OF THE INVENTION

Accordingly, it is an object of the present invention to provide a bracelet fastening device that attaches and holds a bracelet in place while enabling a person to quickly and easily connect the clasp to fasten a bracelet around his or her own wrist.

It is also an object of the present invention to provide such a bracelet fastening device for use by a person in which the bracelet fastening device assists in overcoming the problems associated with fastening a bracelet around one's own wrist without the assistance of another person.

It is another object of the present invention to provide such a bracelet fastening device for use by a person with impaired fine motor skills in which the device assists in fastening a bracelet around one's own wrist.

It is another object of the present invention to provide such a bracelet fastening device that holds one of the interlocking members forming a clasp of a bracelet so that it can be positioned on one's wrist while the person's other free hand connects the other interlocking member to it.

It is still another object of the present invention to provide such a bracelet fastening device that is constructed to be light, durable and portable and easily held and used.

It is still yet another object of the present invention to provide such a bracelet fastening device that is simple in construction and which may be manufactured relatively simply and inexpensively.

It is a more particular object of the present invention to provide such a novel bracelet fastening device having a clamping means composed of biased releasable clamping jaws which are made entirely of plastic so as to eliminate scratching of the jewelry by a metal surface and which are resilient so as to avoid the necessity of using an external or separate spring to bias the jaws together.

Certain of the foregoing and related objects are readily obtained in a bracelet fastening device for use by a person to assist in fastening a bracelet having a releasable clasp having interlocking members, in which the bracelet fastening device generally comprising a handle and a releasable clamping means. The releasable clamping means are operably attached to the handle and the clamping means are operable to releasably hold at least one interlocking member of a releasable clasp of a bracelet. The handle is sized and configured to be held in a hand of a person so that the clamping means is positioned to rest on a wrist adjoining the hand holding the handle so that a person using the bracelet fastening device can hold and position with one hand at least one interlocking member of the releasable clasp on the adjoining wrist while using the other free hand to fasten the other interlocking member of the clasp therewith to securely retain the bracelet around the wrist.

Preferably, the handle is an elongate member having a first end and a second end and is generally circular in cross-section. Desirably, the handle and the clamping means are fabricated from plastic.

Preferably, the clamping means includes a first clamping member and a second clamping member. Advantageously, the second clamping member includes a generally U-shaped biasing member attached to the second clamping member.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views:

FIG. 1 is a side view of a bracelet fastening device embodying the present invention;

FIG. 2 is a top view of the bracelet fastening device shown in FIG. 1;

FIG. 3 is a bottom view of the bracelet fastening device shown in FIG. 1;

FIG. 4 is an end view of a handle of the bracelet fastening device shown in FIG. 1;

FIG. 5 is an end view of clamping means of the bracelet fastening device shown in FIG. 1;

DETAILED DESCRIPTION OF THE PREFERRED EMBODIMENTS

Figure 8D:
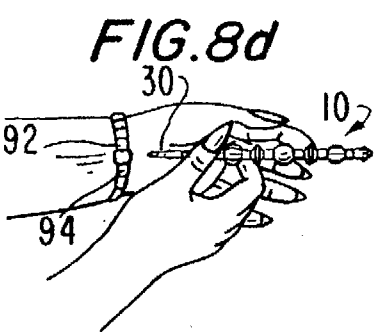
FIGS. 8*a*–8*d* illustrate the steps in using the bracelet fastening device shown in FIG. 1, to assist in wearing a bracelet around an individual's left wrist.

Turning now in detail to the drawings, and in particular to FIGS. 1–5, therein illustrated is an embodiment of a bracelet fastening device 10 for assisting a person in attaching a bracelet around his or her wrist (not shown). Referring specifically to FIGS. 1–3, generally, bracelet fastening device 10 includes a handle 20 and clamping means 30 operatively connected to handle 20.

Handle 20 includes an elongate shaft 22 having a first end 24 and a second end 26 is generally sized and configured to be held in a hand of a person. As shown in FIGS. 4 and 5, elongate shaft 22 is generally circular in cross-section and is suitably comprised of various sized beads 28. Preferably, handle 20 is formed from a plastic material such as polyethylene, or from metal or wood.

Figure 6:
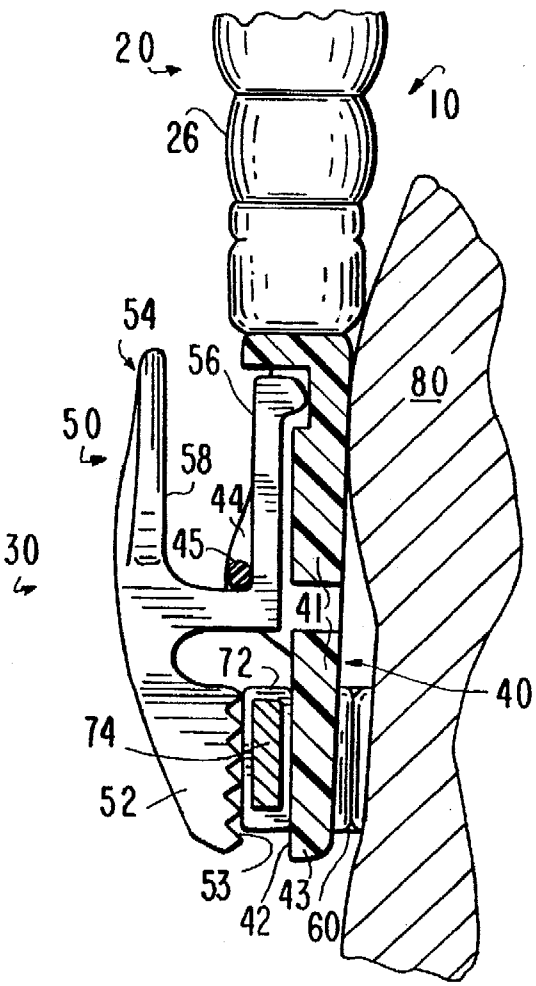
FIG. 6 is an enlarged, part cross-sectional, partial side view of the bracelet fastening device shown in FIG. 1, illustrating the clamping means holding an interlocking member of a clasp of a bracelet in place on the wrist of a person.
Figure 7:
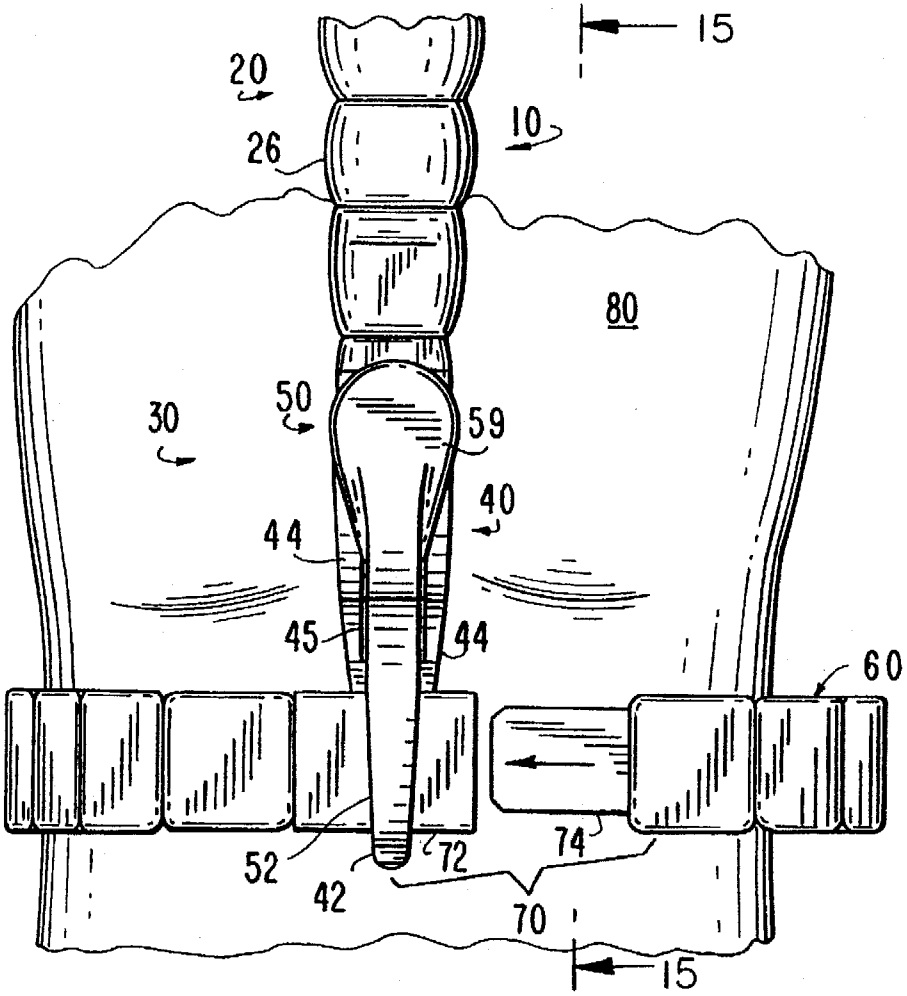
FIG. 7 is an enlarged, partial top view of the bracelet fastening device shown in FIG. 1, illustrating the clamping means holding an interlocking member of a clasp of a bracelet in place on the wrist of a person for connecting the other interlocking member of a clasp.

Referring now to FIGS. 6 and 7, clamping means 30 is illustrated in greater detail. Clamping means 30 is attached to end 26 of handle 20. Clamping means 30 includes a first clamping member 40 and a second juxtaposed clamping member 50. Preferably, first clamping member 40 is integrally formed with handle 20 and is composed of a generally planar elongated base wall 41 having a flat upper surface 42 and a tapered free end 43. Base wall 41 has a pair of spaced apart sidewalls 44, preferably integrally formed therewith, which support a transversely-disposed cross-bar or pin 45.

Second clamping member 50 preferably includes a gripping member 52 such as shown with serrated teeth 53. Referring specifically to FIG. 6, second clamping member 50 further includes a generally U-shaped resilient member 54 integrally-formed and attached to gripping member 52. U-shaped resilient member 50 is operatively attached to first clamping member 40 via sliding first or bottom leg 56 between flat surface 42 and pin 45 of first clamping member 40 so that tab 57, at the end of first leg 56, is retained in a snap-fit manner in cutout 47 in the base all 41 of first clamping member 40.

By pressing the flattened top or finger engaging portion 59 of the free end of upper leg 58 of U-shaped member 54, typically with one's thumb in the direction of the arrow shown in FIG. 6, gripping member 52 is raised or pivoted away from flat surface 42 of first clamping member 40 in a biased manner. Releasing leg 58 allows gripping member 52 to move toward flat surface 42, which is its normal position. Desirably, first clamping member 40 and second clamping member 50 are integrally formed from a plastic material such as polyethylene or other resilient plastic material sufficient to allow flexing of gripping member 52 between a "grasping" and "non-grasping," or open, position with respect to surface 42. The utilization of clamping means 30 eliminates the need for any extended or additional metal spring or the like to bias the gripping member 52 and flat surface 42 together. Thus, the use of resilient plastic for the clamping means significantly minimizes the possibility of scratching of the jewelry (which would be the case if metal were used), and it also eliminates the need for an extra part or separate spring (such as the spring found in a typical metal alligator clip) to bias the clamp members or jaws together.

It is appreciated and desirable that handle 20 and second clamping member 40 are integrally formed as one piece thereby saving in the fabrication and labor costs in producing bracelet fastening device 10. It is also appreciated that the particular shape of the bracelet fastening device, handle and clamping means, may vary from that disclosed in the drawings.

Operation

The operational steps of using bracelet fastening device 10 are shown in FIGS. 8 and 9 which illustrate the use of bracelet fastening device 10 to wear a bracelet on either left and right wrist, respectively. Specifically, FIGS. 8*a*–8*d* illustrate the steps to be performed to wear a bracelet on one's left wrist. FIGS. 9*a*–9*d* illustrate the steps to be performed to wear a bracelet on one's right wrist.

Referring first back to FIGS. 6 and 7, bracelet fastening device 10 is shown holding a bracelet 60 having a releasable clasp 70 having interlocking members, 72 and 74, in place on a wrist 80 of a person to assist in fastening bracelet 60. Specifically, clamping means 30 grips interlocking member 72 and positions it to rest on wrist 80 of the adjoining hand holding handle 20 (not shown) while using the other free hand (not shown) to fasten interlocking member 74 of clasp 70 therewith to securely retain bracelet 60 around wrist 80.

Figure 8C:
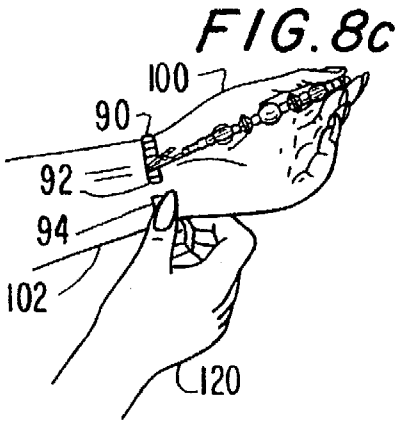
Figure 8B:
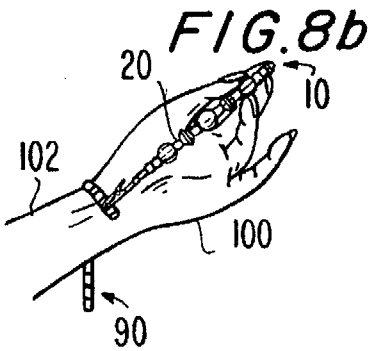
Figure 8A:
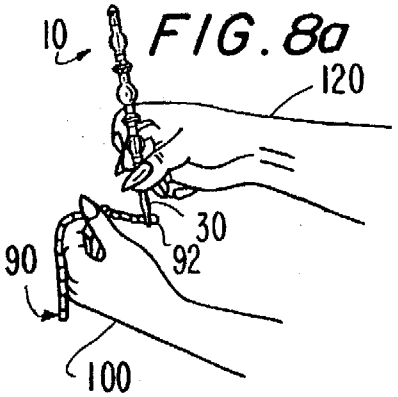

Referring again to FIGS. 8*a*–8*b*, therein illustrated the various steps required for wearing a bracelet on one's left wrist. Beginning with FIG. 8*a*, with clamping means 30 of bracelet fastening device 10 pointing down, clamping means 30 is secured to a ringlet or loop end 92 of bracelet 90. Next, as shown in FIG. 8*b*, with the palm of the left hand 100 facing up, handle 20 of bracelet fastening device 10 is placed in the palm so that clamping means 30 rests on the adjoining wrist 102. Continuing the steps, as shown in FIG. 8*c*, with the right hand 120, grab releasably operable end 94 of bracelet 90 and wrap bracelet 90 around wrist 102 and secure it to ringlet end 92. Once ringlet end 92 and releasably operable end 94 are secure as shown in FIG. 8*d*, release clamping means 30 of bracket fastening device 10.

Figure 9D:
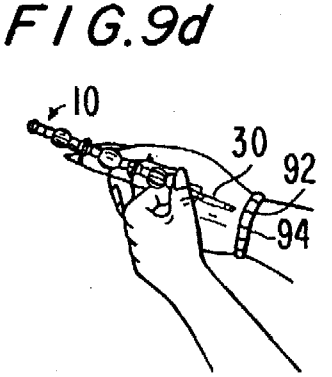
FIGS. 9*a*–9*d* illustrate the steps in using the bracelet fastening device shown in FIG. 1, to assist in wearing a bracelet around an individual's right wrist.
Figure 9C:
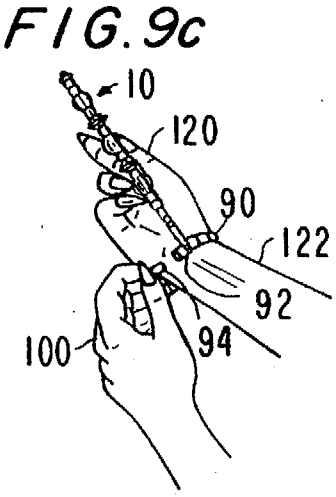
Figure 9B:
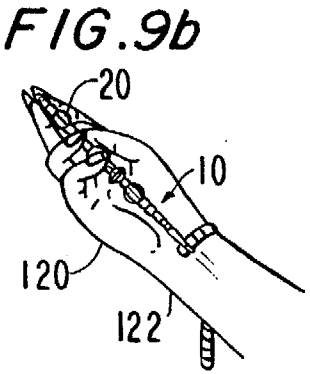
Figure 9A:
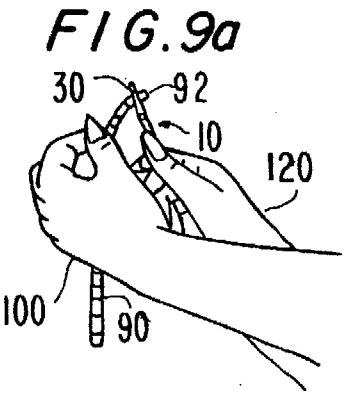

Referring again to FIGS. 9*a*–9*b*, therein illustrated the various steps required for wearing a bracelet on one's right wrist. Beginning with FIG. 9*a*, with clamping means 30 of bracelet fastening device 10 pointing up, clamping means 30 is secured to a ringlet or loop end 92 of bracelet 90. Next, as shown in FIG. 9*b*, with the palm of the right hand 100 facing up, handle 20 of bracelet fastening device 10 is placed in the palm so that clamping means 30 rests on the adjoining wrist 122. Continuing the steps, as shown in FIG. 9*c*, with the left hand 120, grab releasably operable end 94 of bracelet 90 and wrap bracelet 90 around wrist 122 and secure it to ringlet end 92. Once ringlet end 92 and releasably operable end 94 are secure as shown in FIG. 8*d*, release clamping means 30 of bracket fastening device 10.

Thus, while only several embodiments of the present invention have been shown and described, it is obvious that many changes and modification may be made thereunto without departing from the spirit and scope of the invention.

What is claimed is:

1. A bracelet fastening device for use by a person to assist in fastening a bracelet having releasable interlocking members, the bracelet fastening device comprising:

a handle;

means for releasably clamping a portion of a bracelet, said clamping means operably attached to said handle and comprising:

a fixed first clamping jaw coupled to said handle;

a movable second clamping jaw;

a generally U-shaped resilient support having a central base member and a pair of spaced-apart legs extending outwardly from opposite ends of said base member, said pair of legs including a bottom leg mounted adjacent to said fixed first clamping jaw and a top leg having a free end;

said movable clamping jaw being coupled to said central base member and extending in a direction generally opposite to said free end of said top leg, such that, in the normal position thereof, it clampingly engages said fixed clamping jaw;

said free end of said top leg being resiliently movable in a pivot-like manner toward said bottom leg whereby said movable second clamping jaw is thereby resiliently moved in a pivot-like manner away from said fixed clamping jaw into said open position;

wherein said fixed first clamping jaw includes a cutout, said bottom leg of said generally U-shaped resilient support includes a tab, and wherein said tab is receivable in said cutout in a snap-fit manner to retain said generally U-shaped resilient support to said fixed first clamping jaw;

said handle sized and configured to be held in a hand of a person so that said clamping means is positionable proximate to a wrist adjoining the hand holding said handle; and whereby a person using said bracelet fastening device can hold and position with one hand at least one portion of the bracelet on the adjoining wrist while using the other free hand to fasten the interlocking members of the bracelet therewith to secure the bracelet around the wrist.

2. The bracelet fastening device according to claim 1, wherein said fixed first clamping jaw includes a generally flat surface and a pin spaced-apart therefrom, wherein said bottom leg of said generally U-shaped resilient support is receivable and maintained between said flat surface and said pin when said tab is receivable in said cutout.

3. The bracelet fastening device according to claim 1, wherein said top leg of said generally U-shaped resilient support includes a flattened portion generally sized for a person's thumb.

4. The bracelet fastening device according to claim 1, wherein said movable second clamping jaw includes serrated teeth which engage said fixed clamping jaw.

5. The bracelet fastening device according to claim 1, wherein said clamping means is fabricated from plastic.

6. The bracelet fastening device according to claim 1, wherein said handle is an elongate member having a first end and a second end.

7. The bracelet fastening device according to claim 6, wherein said handle is generally circular in cross-section.

8. The bracelet fastening device according to claim 7, wherein said handle is fabricated from plastic.

9. A method of assisting a person in fastening a bracelet comprising interlocking members about the person's wrist, comprising the steps of:

providing a bracelet fastening device having a handle and means for releasably clamping a portion of a bracelet, said clamping means connected to said handle and comprising:

a fixed first clamping jaw coupled to said handle;

a movable second clamping jaw;

a generally U-shaped resilient support having a central base member and a pair of spaced-apart legs extending outwardly from opposite ends of said base member, said pair of legs including a bottom leg mounted adjacent to said fixed first clamping jaw and a top leg having a free end;

said movable clamping jaw being coupled to said central base member and extending in a direction generally opposite to said free end of said top leg, such that, in the normal position thereof, it clampingly engages said fixed clamping jaw;

said free end of said top leg being resiliently movable in a pivot-like manner toward said bottom leg whereby said movable second clamping jaw is thereby resiliently moved in a pivot-like manner away from said fixed clamping jaw into said open position;

wherein said fixed first clamping jaw includes a cutout, said bottom leg of said generally U-shaped resilient support includes a tab, and wherein said tab is receivable in said cutout in a snap-fit manner to retain said generally U-shaped resilient support to said fixed first clamping jaw;

releasably attaching said clamping means to hold a first portion of said bracelet proximate said wrist;

holding said handle with one hand and positioning said clamping means proximate a wrist; and fastening the interlocking members using an opposite hand to secure the bracelet around the wrist.

10. The method according to claim 9, wherein said fixed first clamping jaw includes a generally flat surface and a pin spaced-apart therefrom, and wherein said bottom leg of said generally U-shaped shaped resilient support is receivable and maintained between said flat surface and said pin when said tab is receivable in said cutout.

11. The method according to claim 9, wherein said top leg of said generally U-shaped resilient support includes a flattened portion generally sized for a person's thumb.

12. The method according to claim 9, wherein said movable second clamping jaw includes serrated teeth which engage said fixed clamping jaw.

* * * * *